US008340835B2

(12) United States Patent
Takayama

(10) Patent No.: US 8,340,835 B2
(45) Date of Patent: Dec. 25, 2012

(54) PRINTING APPARATUS WITH PLURAL PAGE PRINT MEDIUM CONVEYANCE CONTROL METHOD

(75) Inventor: Yuuji Takayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 541 days.

(21) Appl. No.: 12/372,856

(22) Filed: Feb. 18, 2009

(65) Prior Publication Data

US 2009/0212481 A1 Aug. 27, 2009

(30) Foreign Application Priority Data

Feb. 21, 2008 (JP) ..... 2008-040453

(51) Int. Cl.
*G05D 13/00* (2006.01)

(52) U.S. Cl. ..... 700/304; 700/13; 700/302

(58) Field of Classification Search ..... 700/304, 700/11, 14, 167
See application file for complete search history.

(56) References Cited

U.S. PATENT DOCUMENTS 7,762,733 B2 * 7/2010 Kakishima et al. ..... 400/76
2006/0193672 A1 * 8/2006 Saito et al. ..... 400/582

FOREIGN PATENT DOCUMENTS

JP 2002-347296 12/2002
JP 2008030466 A * 2/2008

* cited by examiner

*Primary Examiner* — Mohammad Ali
*Assistant Examiner* — Nathan Laughlin
(74) *Attorney, Agent, or Firm* — Fitzpatrick, Cella, Harper & Scinto

(57) ABSTRACT

A printing apparatus is controlled to generate a pulse signal so that a print medium conveyance speed detected by an encoder comes close to a target speed. The duty of the generated pulse signal is calculated every predetermined timing. When a sensor detects the leading end of the print medium, the duty of the pulse signal input to a feed motor is stored in a memory. It is determined whether the difference between the calculated duty and the stored duty has exceeded a predetermined value. If the difference has exceeded the predetermined value, supply of the pulse signal stops. When supply of the pulse stops, a conveyance roller is driven.

6 Claims, 10 Drawing Sheets

PRINTING APPARATUS WITH PLURAL PAGE PRINT MEDIUM CONVEYANCE CONTROL METHOD

BACKGROUND OF THE INVENTION

1. Field of the Invention

The present invention relates to a printing apparatus and print medium conveyance method. Particularly, the present invention relates to a printing apparatus which conveys a print medium such as a print paper sheet and discharges ink from a printhead to print on the print medium, and a print medium conveyance control method.

2. Description of the Related Art

When conveying a print medium such as print paper in a printing apparatus, the following method has conventionally been adopted to prevent the print medium from being diagonally conveyed. More specifically, while a conveyance roller stops or rotates in a direction opposite to the print medium conveyance direction, a feed roller conveys a print medium to make the leading end of the print medium abut against the conveyance roller and to adjust the direction of the print medium. Of such methods, it is well-known to detect the leading end position of a print medium by a print medium position detection sensor arranged immediately before the conveyance roller, then convey the print medium by the feed roller by a distance from the sensor to the conveyance roller, and make the leading end of the print medium abut against the conveyance roller.

However, to increase the throughput, the print medium is generally conveyed to a print start position without performing the control of preventing the diagonal movement of a print medium. In this case, after the print medium position detection sensor arranged immediately before the conveyance roller detects the leading end position of a print medium, the feed roller and conveyance roller convey the print medium by a distance from the sensor to the print start position.

In general, a motor such as a DC motor is used to drive the feed roller and conveyance roller for conveying a print medium. A print medium is generally conveyed by PWM-controlling the motor such as a DC motor. Japanese Patent Laid-Open No. 2002-347296 discloses an arrangement in which when the count at which the duty of a pulse signal supplied to a DC motor becomes a maximum value reaches a predetermined value in PWM-controlling the DC motor, the duty is reset to 0 (zero). When the DC motor is locked, power supply to the DC motor stops to prevent heat-up of the DC motor.

When preventing the diagonal movement of a print medium by the conventional PWM control, abutting of the leading end of a print medium is determined on the basis of whether or not a PWM value serving as the duty of a pulse signal supplied to a motor has exceeded a threshold. However, if feed conditions such as the type of print medium, the arrangement of the conveyance mechanism, and motor performance change, the timing when the PWM value exceeds the threshold also changes. It may be impossible to accurately prevent the diagonal movement of a print medium.

FIG. 10 is a graph for explaining a control method of preventing the diagonal movement of a print medium using the conventional PWM control.

When the PWM value exceeds a predetermined PWM threshold, it is controlled to reset the PWM value to 0 (zero) and stop the conveyance of a print medium. In this case, an abutting detection timing error AX (FIG. 10) may occur depending on a PWM value obtained before the print medium abuts against the conveyance roller. For this reason, the print medium may not be able to satisfactorily abut against the conveyance roller, failing to prevent the diagonal movement of the print medium. To the contrary, the print medium may excessively abut against the conveyance roller and be wrinkled.

The conventional printing apparatus assumes that the feed roller always has a constant frictional force against a print medium and conveys a print medium by this frictional force. However, as the number of fed print media increases, the feed roller may wear or paper dust of a print medium may be attached to the feed roller. If the feed roller wears or paper dust of a print medium is attached to the feed roller, the feed roller and print medium slip during the feed operation. The amount of rotation of the feed roller and the actually moving amount of the print medium may become different from each other. As a result, the feed roller may not be able to accurately convey a print medium. Particularly, when increasing the throughput without performing the control of preventing the diagonal movement of a print medium, the print medium may not be able to be accurately conveyed to the print start position.

SUMMARY OF THE INVENTION

Accordingly, the present invention is conceived as a response to the above-described disadvantages of the conventional art.

For example, a printing apparatus and print medium conveyance control method according to this invention are capable of preventing the diagonal movement of a print medium regardless of a change of print medium feed conditions, and accurately conveying a print medium even when increasing the throughput.

According to one aspect of the present invention, preferably, there is provided a printing apparatus which conveys a print medium up to a print start position from stacking means for stacking print media, and prints on the print medium by a printhead, comprising: a feed roller for picking up a print medium from the print media stacked in the stacking means and conveys the print medium; an encoder, provided on the feed roller, for detecting a conveyance speed of the print medium; a conveyance roller, interposed between the feed roller and the print start position on a conveyance path of the print medium, for conveying the print medium up to the print start position; a sensor, interposed between the feed roller and the conveyance roller on the conveyance path of the print medium, for detecting a leading end of the print medium conveyed by the feed roller; generation means for generating a pulse signal; a feed motor for driving the feed roller by receiving the pulse signal generated by the generation means; control means for controlling the generation means to generate the pulse signal so as to make the conveyance speed of the print medium detected by the encoder come close to a target speed; calculation means for calculating, every predetermined timing, a duty of the pulse signal generated by the generation means; storage means for storing a duty of the pulse signal input to the feed motor when the sensor detects the leading end of the print medium; determination means for determining whether or not a difference between the duty calculated by the calculation means and the duty stored in the storage means has exceeded a predetermined value; stop means for stopping supply of the pulse signal input to the feed motor when the determination means determines that the difference has exceeded the predetermined value; and driving means for driving the conveyance roller when the stop means stops supply of the pulse signal input to the feed motor.

According to another aspect of the present invention, preferably, there is provided a print medium conveyance control method in a printing apparatus including: a feed roller for picking up a print medium stacked in stacking means for stacking print media and conveying the print medium; an encoder, provided on the feed roller, for detecting a conveyance speed of the print medium; a conveyance roller, interposed on a conveyance path of the print medium between the feed roller and a print start position where a printhead prints, for conveying the print medium up to the print start position; a sensor, interposed between the feed roller and the conveyance roller on the conveyance path of the print medium, for detecting a leading end of the print medium conveyed by the feed roller; generation means for generating a pulse signal; and a feed motor for driving the feed roller by receiving the pulse signal generated by the generation means, the method comprising: a control step of controlling the generation means to generate the pulse signal so as to make the conveyance speed of the print medium detected by the encoder come close to a target speed; a calculation step of calculating, every predetermined timing, a duty of the pulse signal generated by the generation means; a storage step of storing a duty of the pulse signal input to the feed motor into a memory when the sensor detects the leading end of the print medium; a determination step of determining whether or not a difference between the duty calculated in the calculation step and the duty stored in the memory has exceeded a predetermined value; a stop step of stopping supply of the pulse signal input to the feed motor when it is determined in the determination step that the difference have exceeded the predetermined value; and a driving step of driving the conveyance roller when supply of the pulse signal input to the feed motor stops in the stop step.

The invention is particularly advantageous since the diagonal movement of a print medium can be prevented regardless of a change of print medium feed conditions, and even when increasing the throughput, the print medium can be accurately conveyed.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Figure 1:
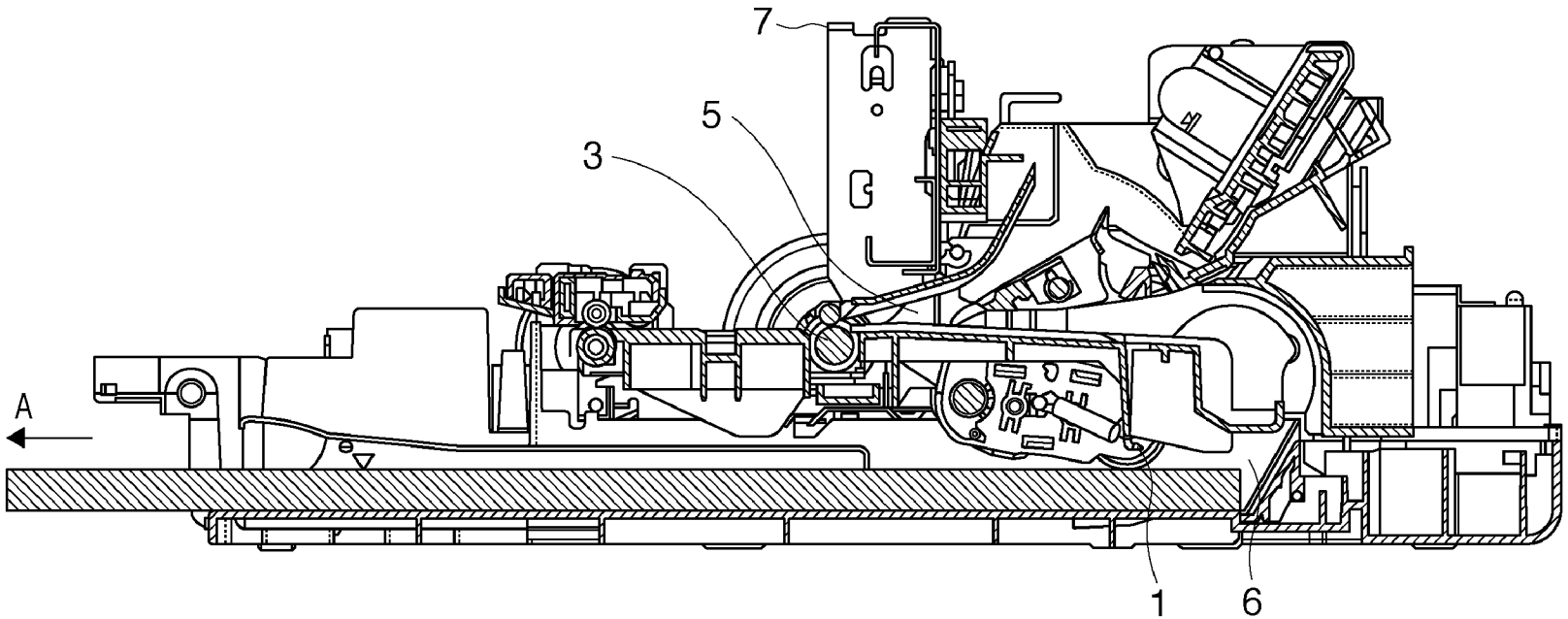
FIG. 1 is a side sectional view showing the mechanism of a printing apparatus as a typical embodiment of the present invention.

FIG. 1 is a side sectional view showing the mechanism of a printing apparatus which prints using an inkjet printhead as a typical embodiment of the present invention.

As shown in FIG. 1, a conveyance roller (LF roller) 3 conveys, in a direction indicated by an arrow A, a print medium (not shown) such as print paper conveyed (fed) from a cassette feed mechanism (PF) 6 via a feed roller 1. Printing is performed by discharging ink droplets from an inkjet printhead (not shown: to be referred to as a printhead hereinafter) mounted in a carriage 7 to the print medium fed by the PF 6. Execution of printing is triggered when a PE sensor 5 for detecting the leading end of a print medium detects the leading end of the conveyed print medium. In the printing apparatus, the PF 6, feed roller 1, PE sensor 5, and conveyance roller 3 are arranged in the order named in the print medium conveyance direction (direction indicated by the arrow A).

Figure 2:
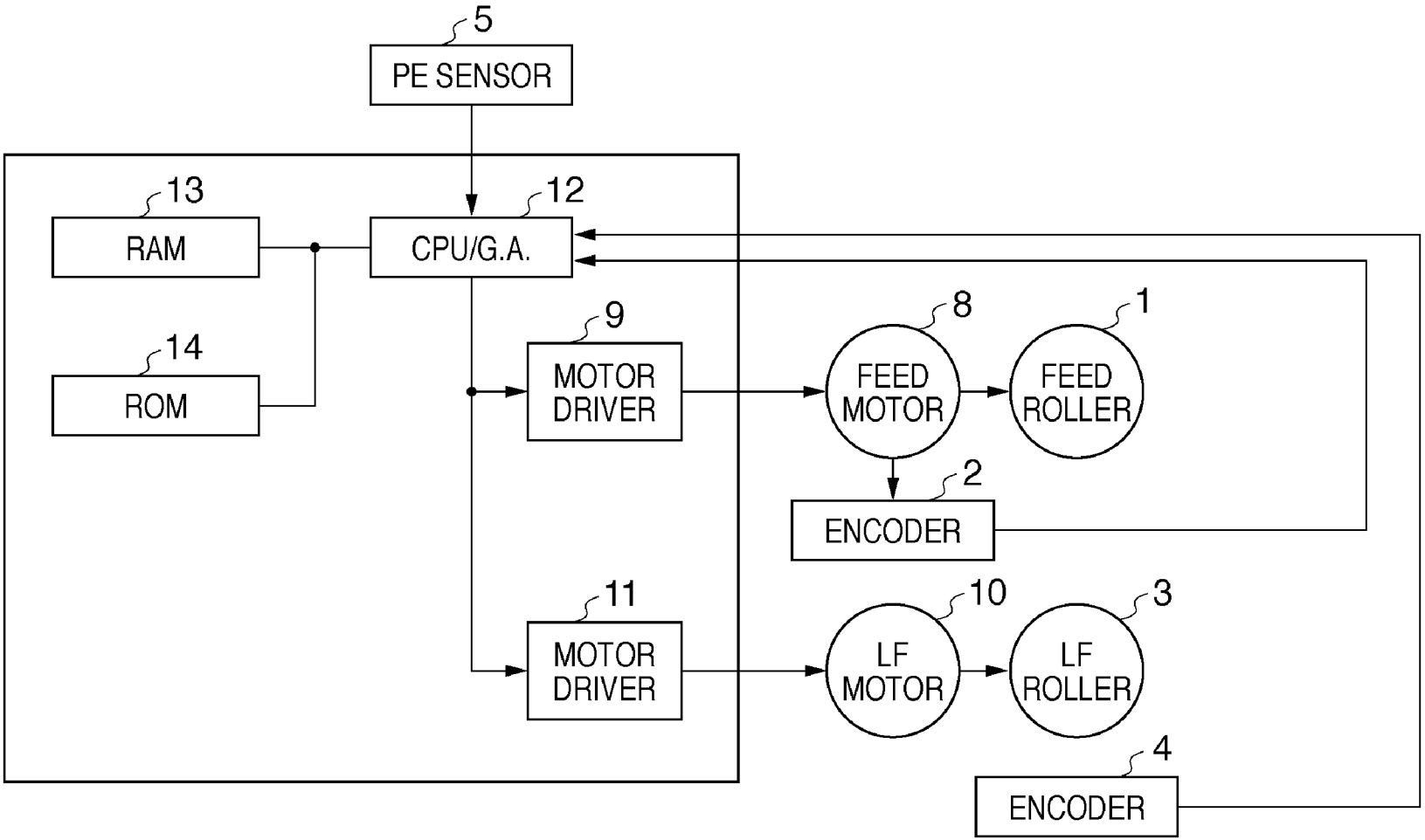
FIG. 2 is a block diagram showing the control arrangement of the printing apparatus shown in FIG. 1.

FIG. 2 is a block diagram showing the control arrangement of the printing apparatus shown in FIG. 1.

The feed roller 1 rotates using a feed motor 8 as a driving source. The feed roller 1 rotates to convey a print medium in a direction indicated by the arrow A in FIG. 1. This rotation is called forward rotation. A CPU/G.A. (Gate Array) 12 instructs the feed motor 8 via a motor driver 9 to drive the feed motor 8. The feed motor 8 is PWM-controlled via the motor driver 9, and a DC motor is employed as the feed motor 8. The PWM control will be explained later.

In the first embodiment, a conveyance motor (LF motor) 10 uses the same type of DC motor as the feed motor 8. The arrangement of the conveyance motor 10 is the same as that of the feed motor 8, and a description thereof will not be repeated.

When the LF roller 3 stops, the leading end of a fed print medium abuts against the LF roller 3 upon forward rotation of the feed roller 1. Hence, even if the print medium is diagonally fed, the direction of the print medium is adjusted to prevent the print medium from being diagonally conveyed. When the LF roller 3 rotates (forward rotation) to convey a print medium in the conveyance direction indicated by the arrow A in FIG. 1, the print medium fed by forward rotation of the feed roller 1 is conveyed to a print start position without stopping the print medium. Thus, an increase in throughput is expected.

The CPU/G.A. 12 controls the overall printing apparatus on the basis of a control program, various parameters, and speed driving pattern stored in a ROM 14 by using a RAM 13 as a work area for executing the programs. The CPU/G.A. 12 also executes arithmetic processing for PWM control. The RAM 13 is also used as, for example, a buffer for storing image data transferred from an external device (not shown) such as a personal computer or digital camera.

The CPU/G.A. 12 receives an output signal from an encoder 2, and obtains the rotational speed of the feed roller 1 and the amount of conveyance by the feed roller 1 in accordance with the output signal from the encoder 2. As for an encoder 4, similar to the encoder 2, the CPU/G.A. 12 receives an output signal from the encoder 4, and obtains the rotational speed of the LF roller 3 and the amount of conveyance by the LF roller 3 in accordance with the output signal from the encoder 4.

Figure 3:
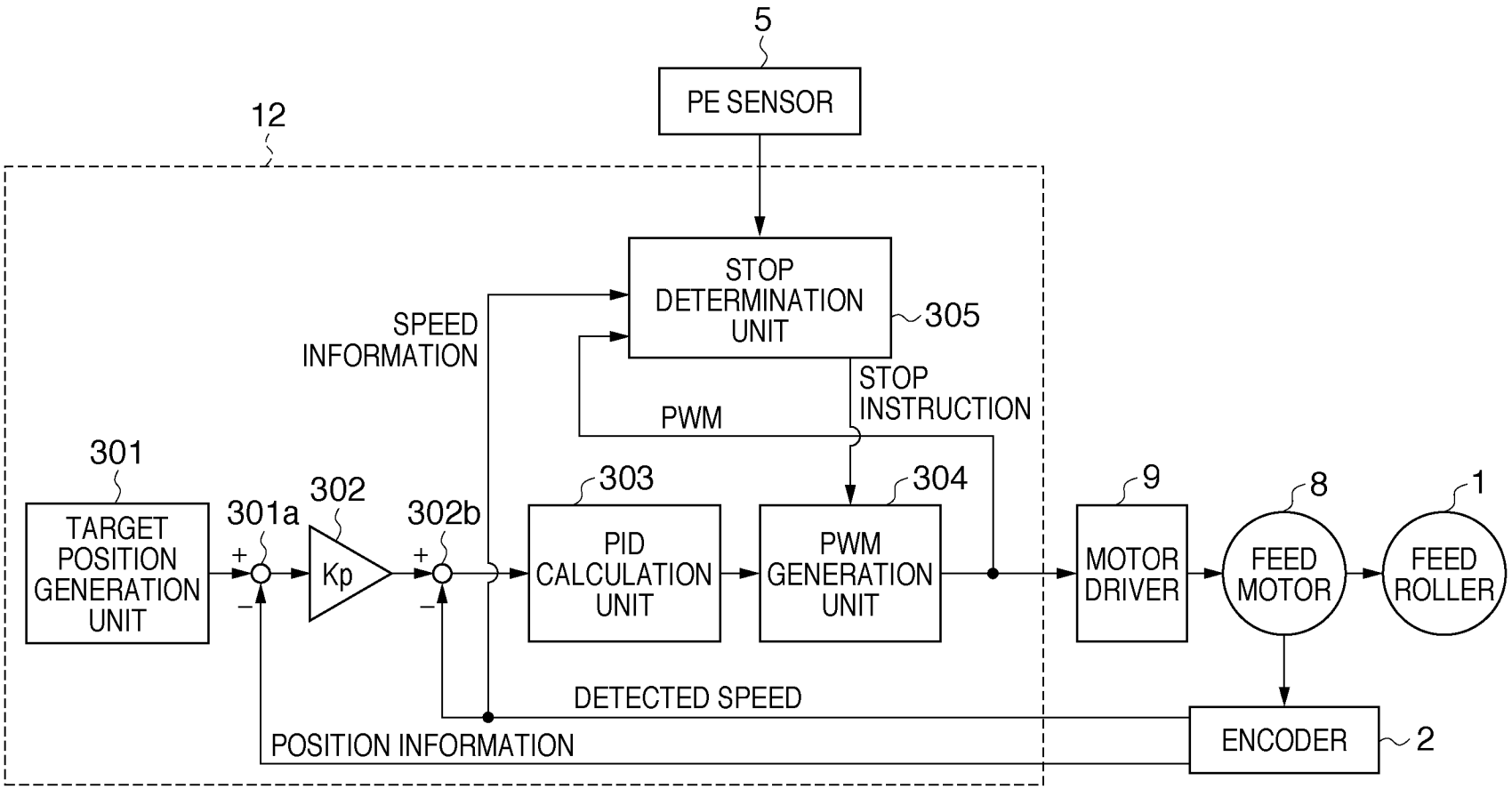
FIG. 3 is a block diagram showing a functional arrangement for servo-controlling a feed motor for driving a feed roller.

FIG. 3 is a block diagram showing a functional arrangement for servo-controlling the feed motor for driving the feed roller.

The CPU/G.A. 12 achieves the servo-control in the embodiment by executing a control program stored in the ROM 14. An ASIC (not shown) incorporated in the CPU/G.A. 12 may also achieve the servo-control in the embodiment. Building components in a block surrounded by a broken line shown in FIG. 3 are functions implemented by a program or the ASIC. Servo-control processing is repeated every predetermined timing, that is, every servo cycle ($\Delta T$).

A target position generation unit 301 generates a target position which incrementally changes up to a final target position (e.g., the print start position of a print medium) by servo-control. To the contrary, the rotational speed and conveyance amount of the feed roller 1 are obtained from an output from the encoder 2, and serve as a print medium conveyance speed and print medium conveyance position, respectively. This calculation is well known, so a description thereof is not repeated. Information on the conveyance speed and conveyance position is fed back to the CPU/G.A. 12. More specifically, the position information is fed back from an adder 301*a* with respect to a target position from the target position generation unit 301. The speed information is fed back from an adder 302*b* with respect to a target speed from a differentiating circuit 302. The speed information is also fed back to a stop determination unit 305 and used to determine whether to stop the feed motor 8.

A pulse signal (PWM signal) calculated and generated via a PID calculation unit 303 and PWM generation unit 304 on the basis of a speed corrected in accordance with speed information from the encoder 2 is output to the motor driver 9. Based on the PWM signal generated by the PWM generation unit 304, the motor driver 9 drives the feed motor 8. The PWM value of the PWM signal is represented by a duty value (the ratio of high level to low level or the ratio of ON to OFF). The PWM value falls within the range of 0% to 100%. As the duty value is larger, power supplied to the motor becomes larger.

The stop determination unit 305 receives speed information fed back from the encoder 2, and also a PWM signal from the PWM generation unit 304 and an output signal from the PE sensor 5. Based on these signals, the stop determination unit 305 outputs a stop instruction to the PWM generation unit 304 to stop the feed roller 1.

Figure 4:
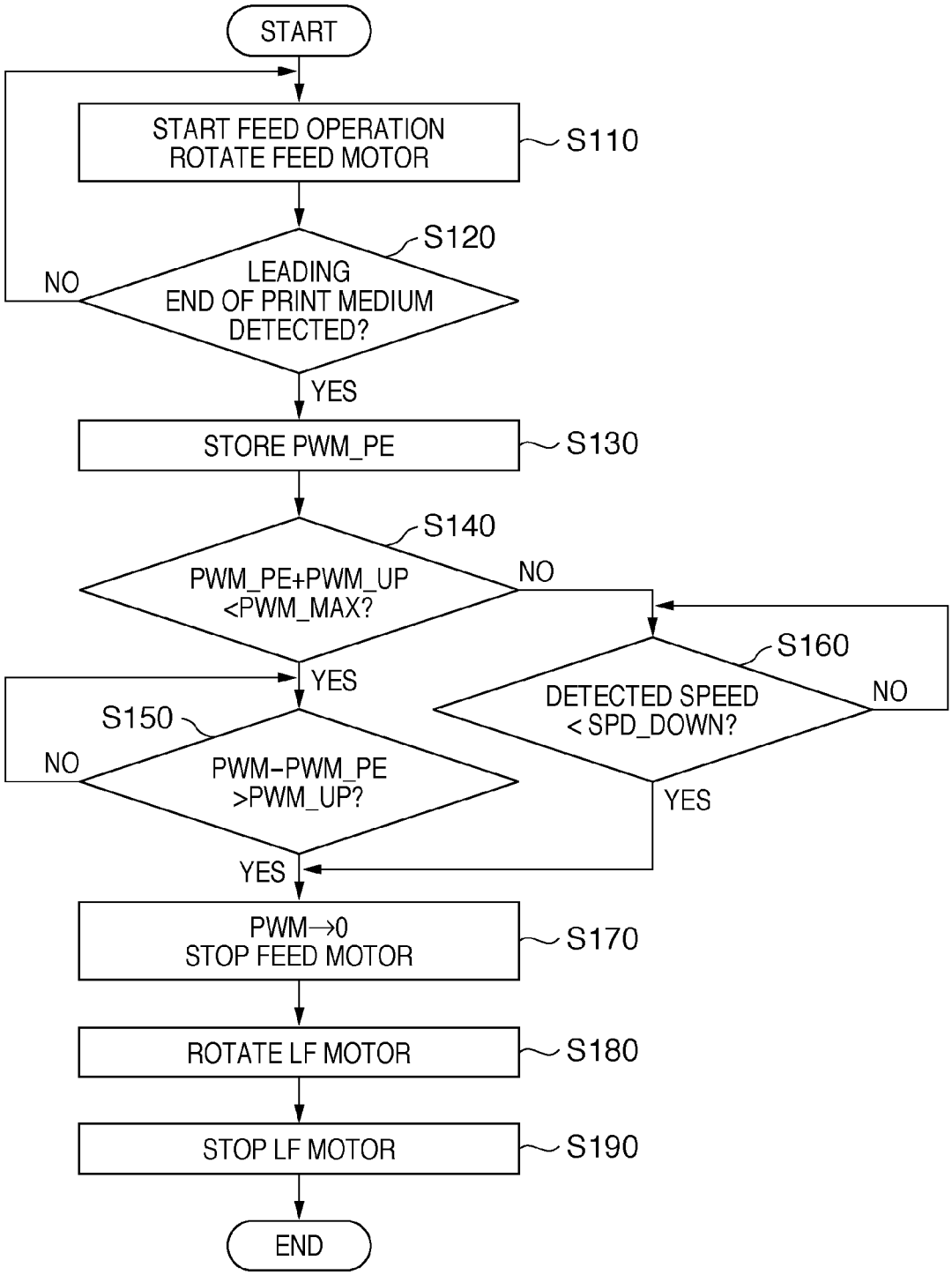
FIG. 4 is a flowchart showing motor control executed by a CPU/G.A.

FIG. 4 is a flowchart showing motor control executed by the CPU/G.A. 12 as print medium conveyance control according to the present invention.

In step S110, when the feed operation starts, the feed motor 8 rotates forward to drive the feed roller 1. The feed roller 1 picks up one of print media stacked in the PF 6, and feeds it.

If the print medium is fed by rotation of the feed roller 1, it is determined in step S120 on the basis of an output signal from the PE sensor 5 whether or not the leading end of the print medium has been detected. If it is determined that the leading end of the print medium has been detected, the process advances to step S130. If it is determined that the leading end of the print medium has not been detected, the process returns to step S110 to keep rotating forward the feed roller 1 and feeding the print medium. After the servo cycle, the determination in step S120 is executed again.

In step S130, a PWM value (PWM_PE) obtained when the PE sensor 5 detects the leading end of the print medium is temporarily stored in a memory serving as a storage means such as the RAM 13 or a register (not shown).

In step S140, it is determined whether or not the sum of the PWM value obtained upon detecting the leading end of the print medium and a predetermined first threshold (PWM_UP) is smaller than the upper limit value (PWM_MAX) of a PWM signal generated by the PWM generation unit 304. The first threshold (PWM_UP) is a value used for determining an increase from the PWM value obtained upon detecting the leading end of a print medium.

If it is determined in step S140 that PWM_PE+PWM_UP<PWM_MAX, the process advances to step S150. In step S150, the current PWM value (PWM) is calculated, and it is determined whether the calculated PWM value has increased by more than the first threshold (PWM_UP) from one obtained upon detecting the leading end of the print medium. That is, if PWM−PWM_PE>PWM_UP, the process advances to step S170. If PWM−PWM_PE<PWM_UP, the determination in step S150 is executed again after the servo cycle.

If it is determined in step S140 that PWM_PE+PWM_UP>PWM_MAX (the sum of PWM_PE and PWM_UP is equal to or larger than the maximum duty of the PWM signal), the PWM value obtained upon detecting the leading end of the print medium has already come close to the upper limit output value of the PWM signal. Hence, it is determined that it is not effective to determine an increase from the PWM value obtained upon detecting the leading end of the print medium. Then, the process advances to step S160. This processing is sometimes executed when the print operation continues, and as a result of this, the load on the print medium conveyance mechanism of the printing apparatus increases, the feed motor 8 heats up, and the output torque decreases.

In step S160, it is determined whether or not a print medium conveyance speed (detected speed) detected by the encoder 2 lowers below a predetermined speed (SPD_DOWN). In the embodiment, SPD_DOWN is set slightly lower than the target speed. If the detected speed <SPD_DOWN, the process advances to step S170. If the detected speed ≧SPD_DOWN, the determination in step S160 is executed again after the servo cycle.

In step S170, the PWM value is set to "0" (0%) to stop the feed motor and stop the feed roller 1. More specifically, the stop determination unit 305 issues a stop instruction to the PWM generation unit 304.

Figure 5:
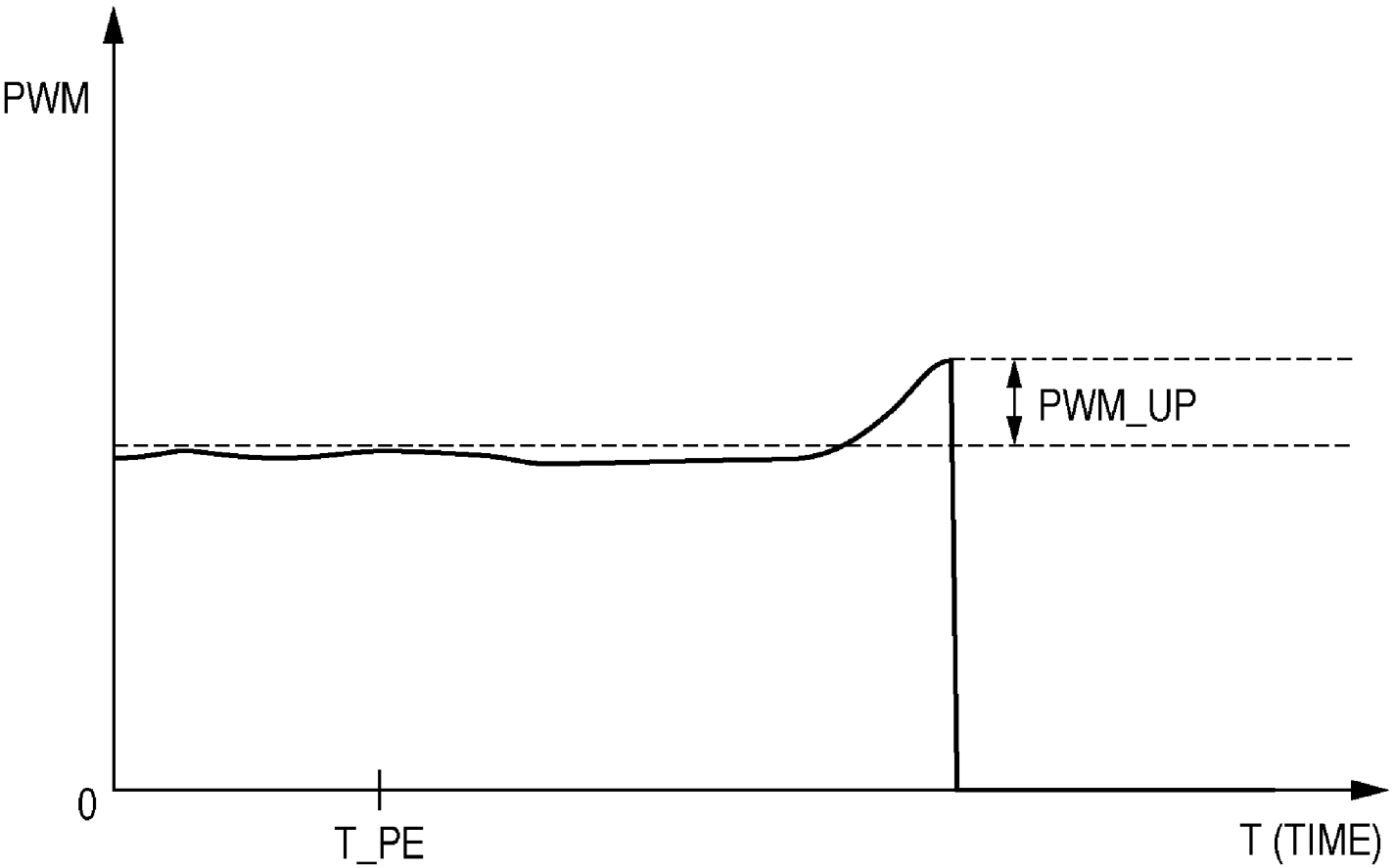
FIG. 5 is a graph showing a temporal change of the PWM signal.

FIG. 5 is a graph showing a temporal change of the PWM signal. FIG. 5 particularly shows temporal changes of the PWM signal in steps S120 to S150 and S170. In FIG. 5, T_PE indicates a time when the leading end of a print medium is detected. In FIG. 5, when PWM then increases by the first threshold (PWM_UP) from the PWM signal obtained upon detecting the leading end of a print medium, the PWM signal is controlled to be "0".

Figure 6:
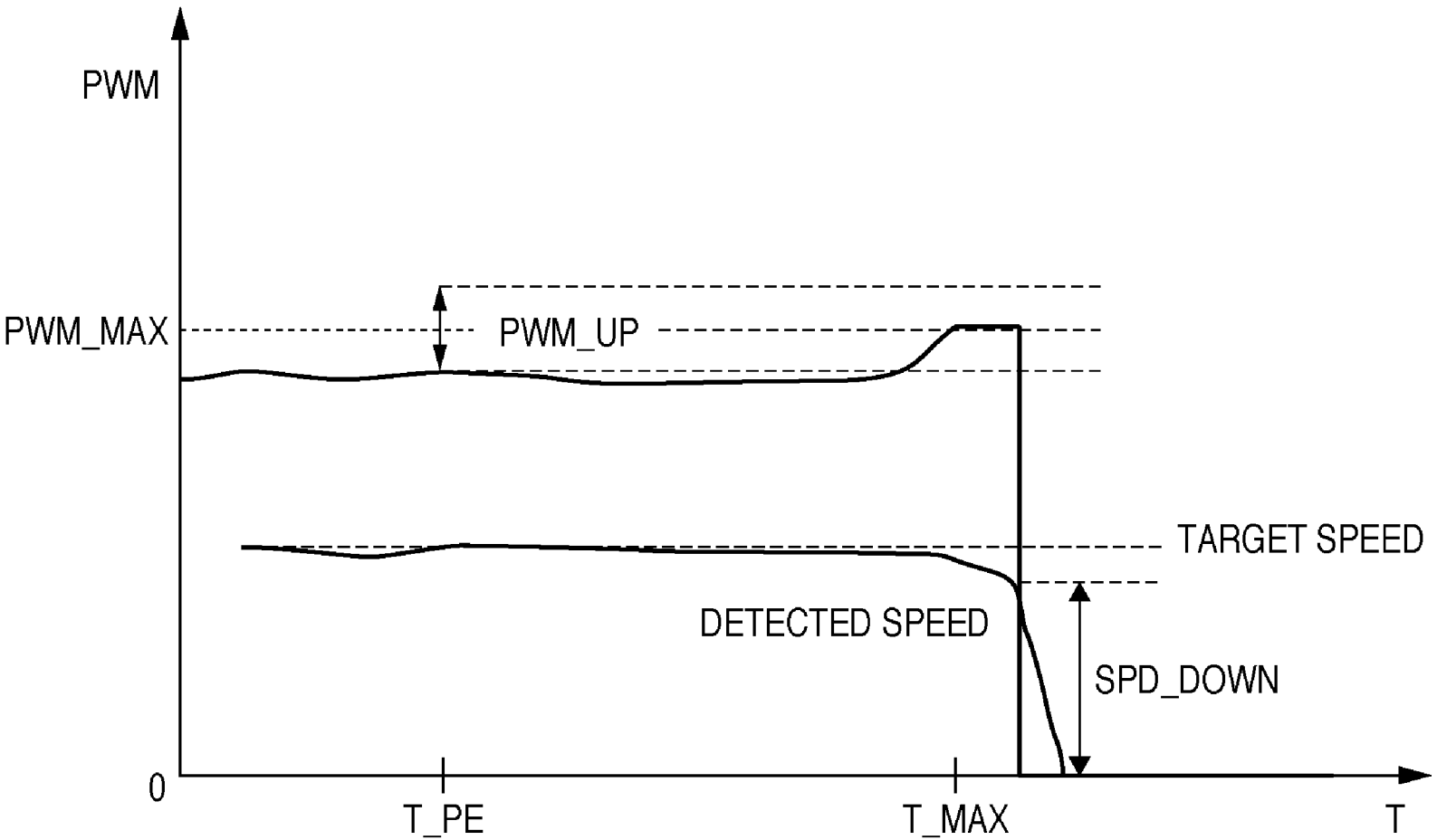
FIG. 6 is a graph showing temporal changes of the PWM signal and detected speed.

FIG. 6 is a graph showing temporal changes of the PWM signal and detected speed. FIG. 6 particularly shows temporal changes of the PWM signal and detected speed in steps S120 to S140, S160, and S170. In FIG. 6, after T_PE indicating a timing when the leading end of a print medium is detected, the PWM value reaches the upper limit value (PWM_MAX) at time T=T_MAX. The PWM value is kept at PWM_MAX. The upper limit value of the PWM value is 100%. When the detected speed starts lowering below the target speed, and lowers below SPD_DOWN, the PWM signal is controlled to be "0".

These processes are summarized as follows. When it is detected that the PWM signal has increased by a predetermined value from one obtained upon detecting the leading end of a print medium, it is determined that the leading end of the print medium has abutted against the conveyance roller, and the feed motor stops. When a PWM signal obtained upon detecting the leading end of a print medium is close to the upper limit value, a decrease in detected speed is detected, and when the detected speed lowers below a predetermined speed, the feed motor stops.

In step S180, driving of the LF motor 10 starts to rotate forward the LF roller 3. At this time, the leading end of the print medium has already abutted against the LF roller 3, and the print medium is conveyed in the direction indicated by the arrow A in FIG. 1.

When the print medium reaches the print start position, driving of the LF motor 10 stops in step S190, completing the series of feed operations.

Figure 7:
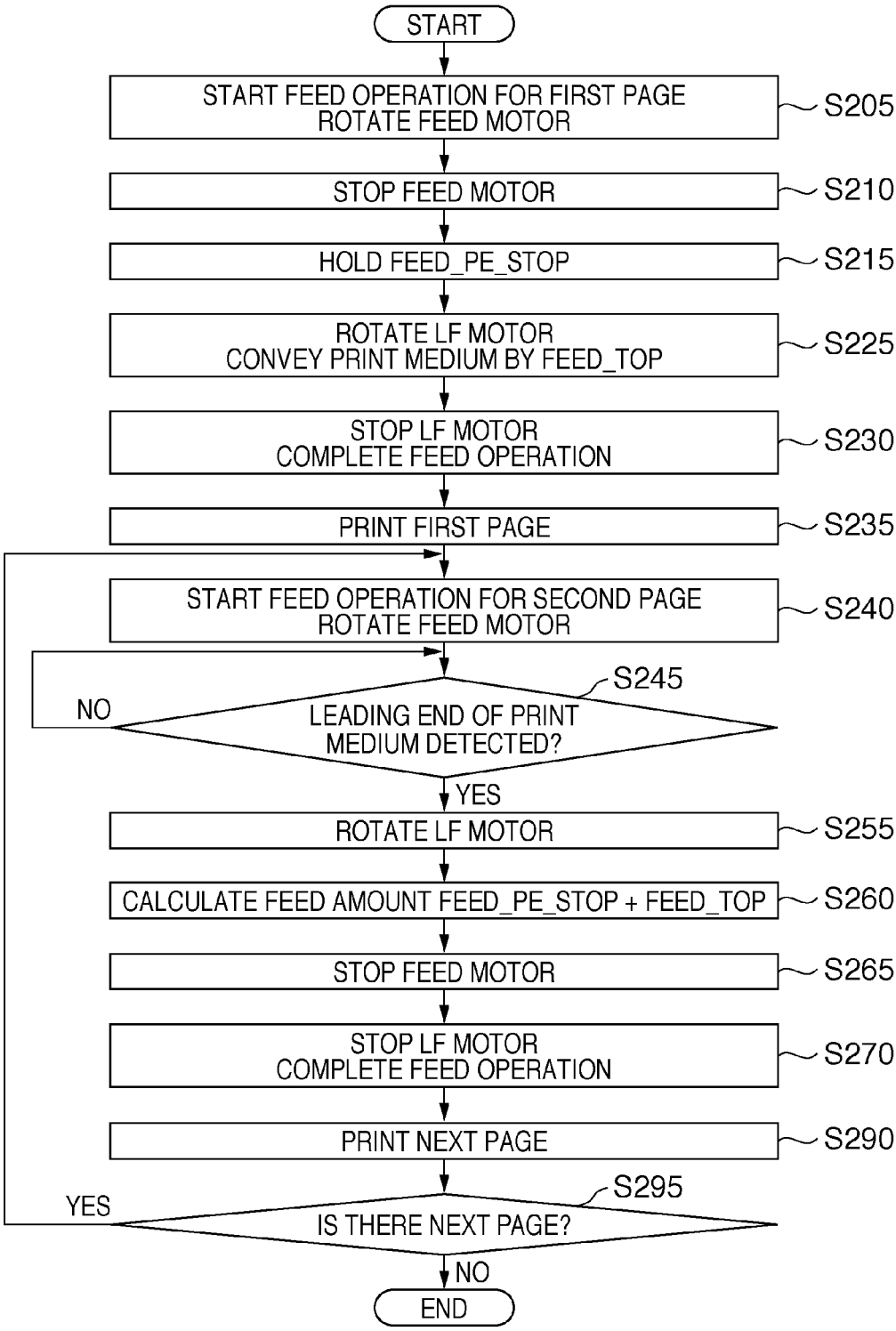
FIG. 7 is a flowchart showing a continuous feed sequence.

FIG. 7 is a flowchart showing a continuous feed sequence.

For example, when printing based on print data input from a host apparatus, the CPU/G.A. 12 determines whether to print on a plurality of print media, thereby determining whether to perform continuous feed.

Steps S205 to S230 in FIG. 7 represent almost the same processes as those in steps S110 to S190 in FIG. 4.

In step S205, a feed operation for the first page starts. Then, driving of the feed motor 8 starts, and the feed roller 1 rotates to pick up one of print media stacked in the PF 6 and feed it. This is the same process as step S110.

In step S210, it is detected that the print medium conveyed by the feed roller 1 has abutted against the LF roller 3, and the feed motor 8 stops. This corresponds to the process in step S170.

In step S215, the memory temporarily stores a print medium conveyance amount (FEED_PE_STOP) until it is detected that the print medium has abutted against the LF roller 3 after the PE sensor 5 detects the leading end of the print medium.

In step S225, driving of the LF motor 10 starts to rotate forward the LF roller 3 and convey the print medium by a conveyance amount (FEED_TOP) up to the print start position. This corresponds to the process in step S180.

If the print medium reaches the print start position, driving of the LF motor 10 stops to complete the feed operation in step S230. This corresponds to the process in step S190.

The print operation is performed on the print medium conveyed up to the print start position in step S235. At the end of this step, the series of operations for printing the first page is completed.

In step S240, a feed operation for the next page starts. Then, driving of the feed motor 8 starts, and the feed roller 1 rotates to pick up one of print media stacked in the PF 6 and feed it.

The fed print medium is kept conveyed by the feed roller 1. In step S245, the PE sensor 5 detects the leading end of the print medium at the interval of the servo cycle ($\Delta T$).

After the PE sensor 5 detects the leading end of the print medium, driving of the LF motor 10 starts to rotate forward the LF roller 3 in step S255. When the print medium is conveyed up to the LF roller 3, it is kept to be conveyable to the print start position without stopping the print medium.

When the PE sensor 5 detects the leading end of the print medium, the position of the leading end of the print medium is finalized. Thus, in step S260, a conveyance amount (FEED_PE_STOP+FEED_TOP) from the print medium leading end detected position up to the print start position is calculated.

If the print medium conveyed by the feed roller 1 reaches the LF roller 3, the feed motor 8 stops to stop rotation of the feed roller 1 in step S265. At this time, the print medium is kept conveyed by the LF roller 3 from the print medium leading end position detected by the PE sensor 5 by the conveyance amount up to the print start position that has been calculated in step S260.

If the print medium reaches the print start position, driving of the LF motor 10 stops in step S270, completing the feed operation.

The print medium conveyed up to the print start position undergoes the print operation in step S290. At the end of this step, the series of operations for printing the next page is completed.

Step S295 represents that the processes in steps S240 to S290 are repetitively executed for the second and subsequent pages, that is, until print media are successively fed for a plurality of pages.

Figure 8:
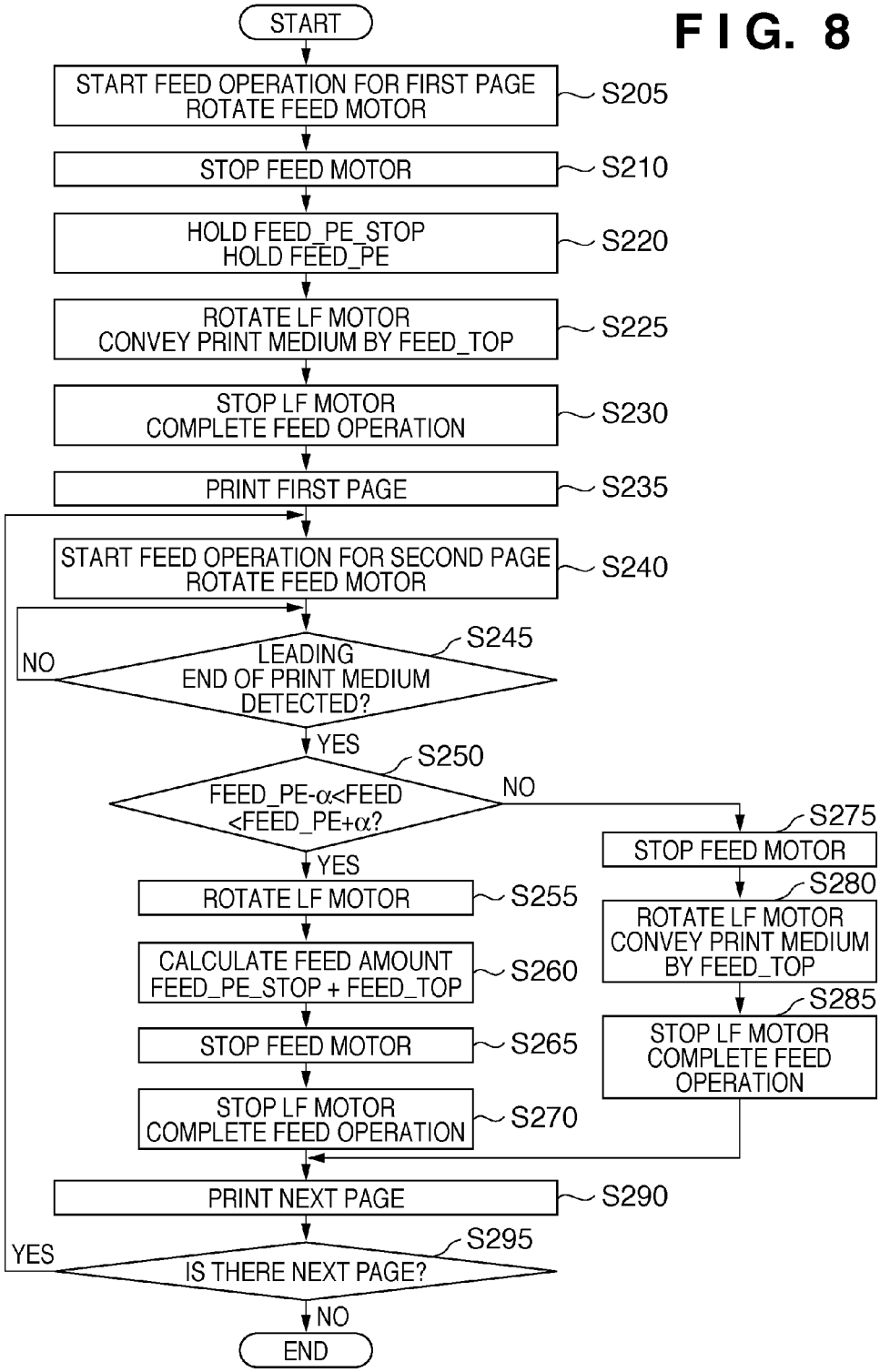
FIG. 8 is a flowchart showing a continuous feed sequence.

FIG. 8 is a flowchart showing another continuous feed sequence.

In this sequence, many processes are common to those in the sequence of FIG. 7, and are denoted by the same step numbers. Since processes of the same step numbers as those in the sequence of FIG. 7 are common, only steps for performing different processes will be explained.

Steps S205 and S210 are common to those in the sequence of FIG. 7. In step S220, the memory temporarily stores a print medium conveyance amount (FEED_PE_STOP) until it is detected that the print medium has abutted against the LF roller 3 after the PE sensor 5 detects the leading end of the print medium. The memory also temporarily stores the print medium conveyance amount (FEED_PE) of the first page until the PE sensor 5 detects the leading end of the print medium after the start of pickup.

Steps S225 to S245 are common to those in the sequence of FIG. 7.

If the PE sensor 5 detects the leading end of a print medium for the next page, it is determined in step S250 whether or not a slip between the feed roller 1 and the print medium or double feed has occurred upon pickup. More specifically, it is checked using FEED_PE of the first page as a reference whether or not a conveyance amount (FEED) until the PE sensor 5 detects the leading end of the currently conveyed print medium after the start of pickup falls within an allowable error range ($\alpha$), that is, whether or not $FEED_PE-\alpha<FEED<FEED_PE+\alpha$ is satisfied. If the conveyance amount (FEED) falls within the allowable error range, the currently conveyed print medium suffices to be conveyed by the same conveyance amount as that for the first page, and the process advances to step S255. Steps S255 to S270 are common to those in the sequence of FIG. 7. If the conveyance amount (FEED) falls outside the allowable error range, a slip or double feed may have occurred until the PE sensor 5 detects the leading end. Hence, to reliably feed the print medium, the process advances to step S275.

In step S275, it is determined by the same process as step S210 that the print medium conveyed by the feed roller 1 has abutted against the LF roller 3, and the feed motor 8 stops.

In step S280, by the same process as step S225, driving of the LF motor 10 starts to rotate forward the LF roller 3 and convey the print medium by a conveyance amount (FEED_TOP) up to the print start position.

If the print medium reaches the print start position, driving of the LF motor 10 stops to complete the feed operation in step S285.

Steps S290 and S295 are common to those in the sequence of FIG. 7.

As described above, according to the embodiment, in paper feed for preventing diagonal movement, a PWM value obtained upon detecting the leading end of a print medium is used as a reference. Based on the sum of the PWM value and a predetermined value, it is determined that the print medium has abutted against the conveyance roller. Then, feed by the feed roller stops. If the sum of the PWM value and predetermined value exceeds a maximum PWM output value, a decrease in print medium conveyance speed is detected to stop feed by the feed roller. Since abutting of a print medium against the conveyance roller can be determined regardless of feed conditions, diagonal movement can be prevented regardless of feed conditions.

In paper feed for increasing the throughput, print media for the second and subsequent pages can be conveyed up to the print start position after the start of pickup without stopping them, by using a conveyance amount until it is detected that a print medium for the first page has abutted against the conveyance roller after the leading end of the print medium is detected. Further, only when a slip or double feed occurs during pickup in feeding print media for the second and subsequent pages, the leading end of each print medium can be made to abut against the conveyance roller and fed by using a conveyance amount until the leading end of the print medium is detected after the start of pickup.

In this manner, according to the embodiment, in paper feed for preventing diagonal movement, it is controlled to stop rotation of the feed roller under a combination of conditions. For this reason, various feed conditions can be coped with to appropriately prevent diagonal movement in feeding a print medium. In paper feed for increasing the throughput, a conveyance amount corresponding to a feed state is used, and it is controlled based on the conveyance amount to change the feed method. Thus, various feed conditions can be coped with to appropriately increase the throughput.

Figure 9:
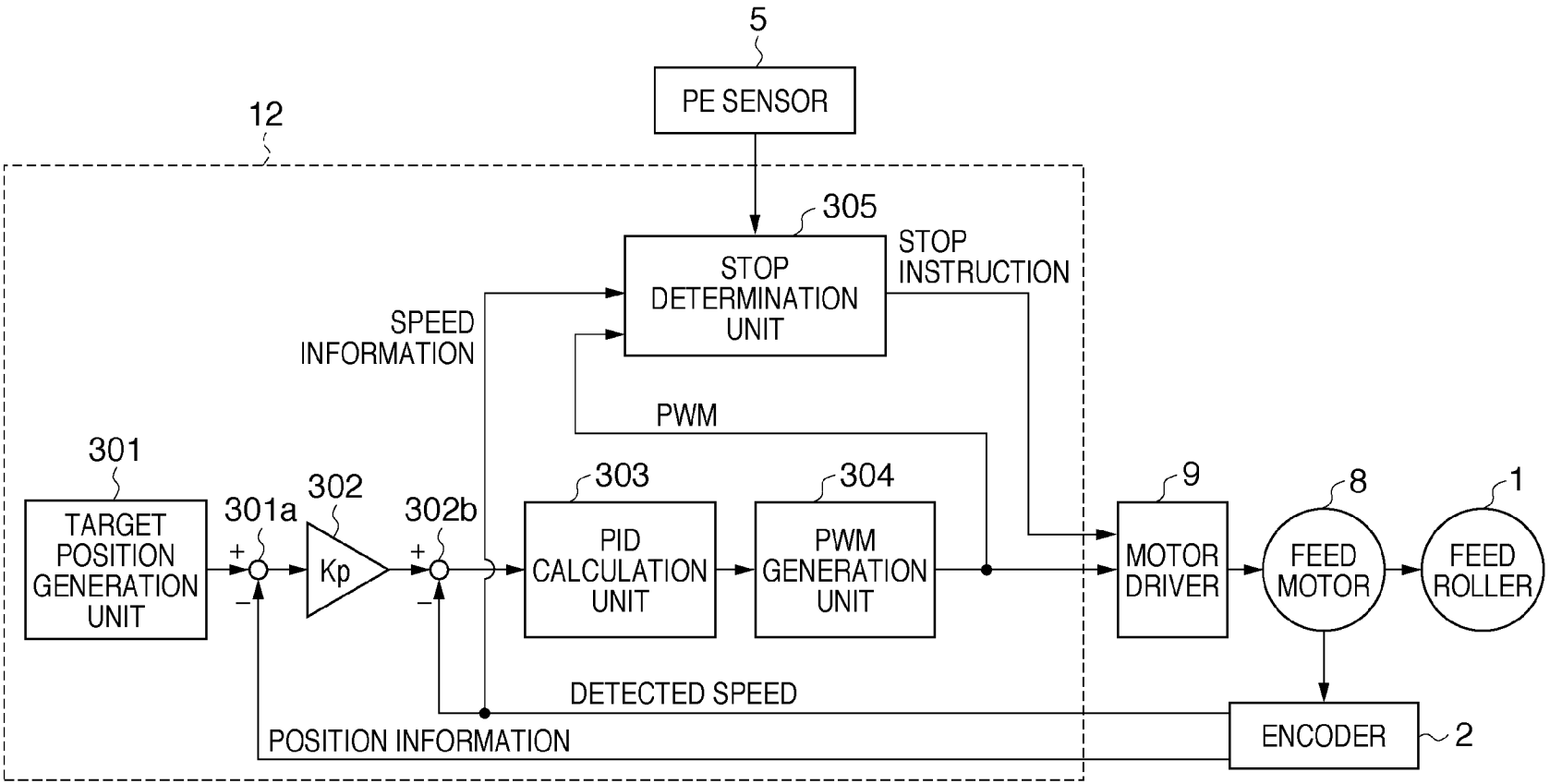
FIG. 9 is a block diagram showing a functional arrangement for servo-controlling the feed motor for driving the feed roller.
Figure 10:
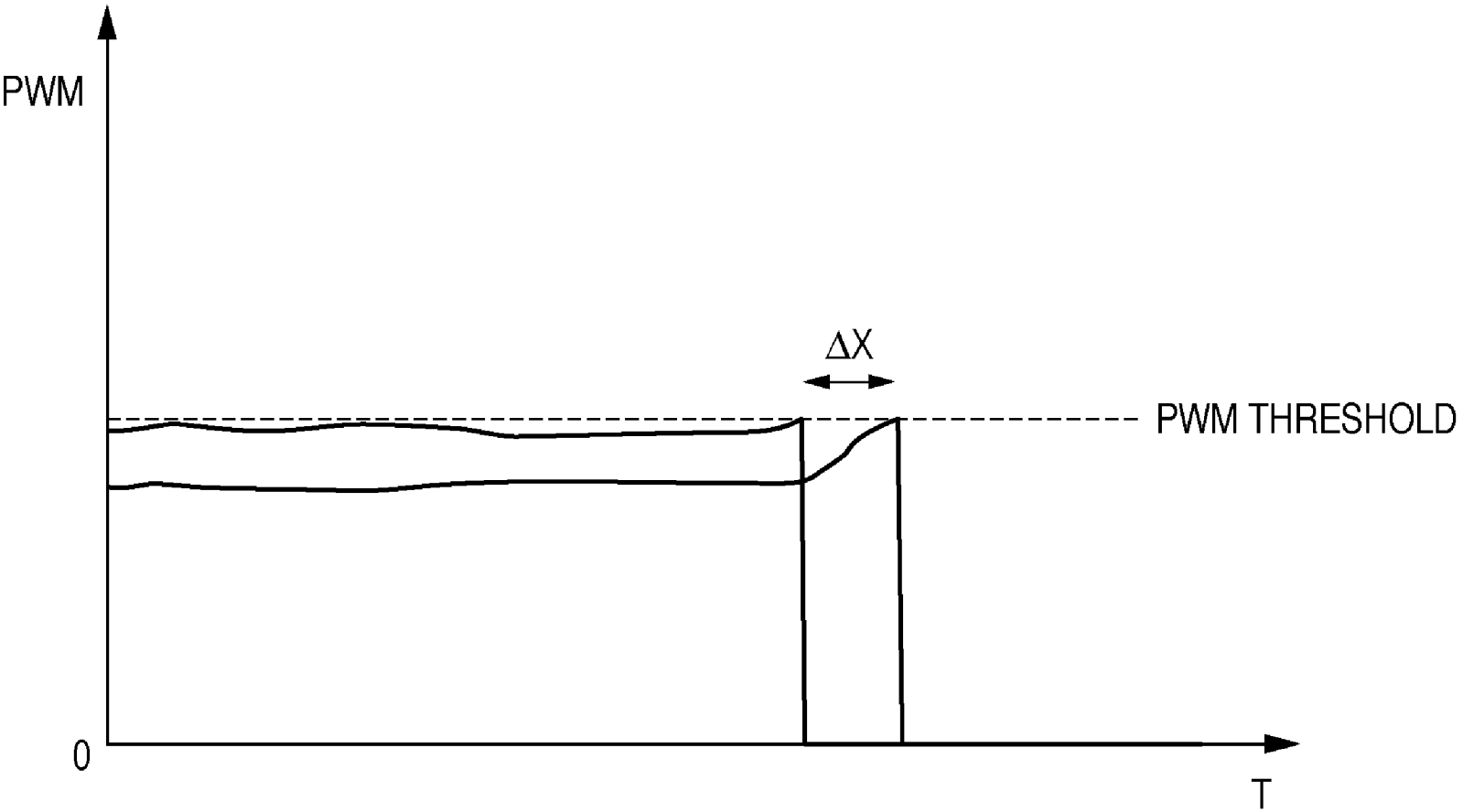
FIG. 10 is a graph for explaining a control method of preventing the diagonal movement of a print medium using conventional PWM control.

In the above-described embodiment, the stop determination unit issues a stop instruction to the PWM generation unit to stop the rotation of the feed roller, as shown in FIG. 3. However, the present invention is not limited to this arrangement. For example, as shown in FIG. 9, the stop determination unit may also directly issue a stop instruction to the motor driver. The difference between the arrangements of FIGS. 9 and 3 is only output of a stop instruction, the remaining arrangement is the same, and a description thereof will not be repeated.

The printing apparatus according to the above-described embodiment is an inkjet printing apparatus having a printhead in which electrothermal transducers and means for generating heat energy such as a laser beam are arranged at high density in order to discharge ink. The printing apparatus prints by changing the ink state by heat energy and discharging ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-40453, filed Feb. 21, 2008, which is hereby incorporated by reference herein in its entirety.

What is claimed is:

1. A printing apparatus which conveys a print medium up to a print start position from stacking means for stacking print media, and prints on the print medium by a printhead, comprising:

a feed roller for picking up a print medium from the print media stacked in the stacking means and conveying the print medium;

an encoder for detecting a conveyance speed and a conveyance amount of the print medium by said feed roller;

a conveyance roller, interposed between said feed roller and the print start position on a conveyance path of the print medium, for conveying the print medium up to the print start position;

a sensor, interposed between said feed roller and said conveyance roller on the conveyance path of the print medium, for detecting a leading end of the print medium conveyed by said feed roller;

generation means for generating a pulse signal;

a feed motor for driving said feed roller by receiving the pulse signal generated by said generation means;

control means for controlling said generation means to generate the pulse signal so as to make the conveyance speed of the print medium detected by said encoder come close to a target speed;

calculation means for calculating, every predetermined timing, a duty of the pulse signal generated by said generation means;

storage means for storing a duty of the pulse signal input to said feed motor when said sensor detects the leading end of the print medium;

determination means for determining whether or not a difference between the duty calculated by said calculation means and the duty stored in said storage means has exceeded a predetermined value;

stop means for stopping supply of the pulse signal input to said feed motor when said determination means determines that the difference has exceeded the predetermined value; and driving means for driving said conveyance roller when said stop means stops supply of the pulse signal input to said feed motor, wherein in a case where printing is on plural pages of print media, said storage means stores a conveyance amount of a print medium for a first page that is detected by said encoder until said stop means stops supply of the pulse signal input to said feed motor after said sensor detects the leading end of the print medium, and when printing on print media for a second and subsequent pages, said stop means stops supply of the pulse signal input to said feed motor when said encoder detects that the print medium has been conveyed by the same as the conveyance amount of the print medium for the first page stored in said storage means after said sensor detects the leading end of the print media for the second and subsequent pages.

2. The apparatus according to claim 1, wherein said encoder further detects a conveyance amount of the print medium, said storage means further stores the conveyance amount of the print medium for the first page that is detected by said encoder until said sensor detects the leading end of the print medium after said feed roller picks up the print medium, and said stop means stops supply of the pulse signal input to said feed motor when a difference between the conveyance amount and conveyance amounts of the print media for the second and subsequent pages that correspond to the conveyance amount falls within a predetermined allowable error range, and after said sensor detects the leading end of a print medium, said encoder detects that the print medium has been conveyed by the same as the conveyance amount until supply of the pulse signal stored in said storage means stops.

3. A print medium conveyance control method in a printing apparatus including: a feed roller for picking up a print medium stacked in stacking means for stacking print media and conveying the print medium; an encoder for detecting a conveyance speed and a conveying amount of the print medium by the feed roller; a conveyance roller, interposed on a conveyance path of the print medium between the feed roller and a print start position where a printhead prints, for conveying the print medium up to the print start position; a sensor, interposed between the feed roller and the conveyance roller on the conveyance path of the print medium, for detecting a leading end of the print medium conveyed by the feed roller; generation means for generating a pulse signal; and a feed motor for driving the feed roller by receiving the pulse signal generated by the generation means, the method comprising:

a control step of controlling the generation means to generate the pulse signal so as to make the conveyance speed of the print medium detected by the encoder come close to a target speed;

a calculation step of calculating, every predetermined timing, a duty of the pulse signal generated by the generation means;

a storage step of storing a duty of the pulse signal input to the feed motor into a memory when the sensor detects the leading end of the print medium;

a determination step of determining whether or not a difference between the duty calculated in the calculation step and the duty stored in the memory has exceeded a predetermined value;

a stop step of stopping supply of the pulse signal input to the feed motor when it is determined in the determination step that the difference have exceeded the predetermined value; and a driving step of driving the conveyance roller when supply of the pulse signal input to the feed motor stops in the stop step, wherein in a case where printing is on plural pages of print media, the storage step stores into the memory a conveyance amount of a print medium for a first page that is detected by the encoder until the stop steps stops supply of the pulse signal input to the feed motor after the sensor detects the leading end of the print medium, and when printing on print media for a second and subsequent pages, the stop step stops supply of the pulse signal input to the feed motor when the encoder detects that the print medium has been conveyed by the same as the conveyance amount of the print medium for the first page stored in the memory after said sensor detects the leading end of the print media for the second and subsequent pages.

4. The apparatus according to claim 1, wherein when a sum of the duty stored in said storage means and the predetermined value is equal to or greater than a maximum duty of the pulse signal generated by said generation means, and the conveyance speed of the print medium detected by said encoder lowers below a predetermined speed, said stops means stops supply of the pulse signal input to said feed motor.

5. The apparatus according to claim 1, wherein the predetermined value includes a value which allows detecting that a print medium conveyed by said feed roller has abutted against said conveyance roller.

6. The apparatus according to claim 1, wherein said feed motor includes a DC motor.

* * * * *